United States Patent [19]

Ku

[11] Patent Number: 4,699,392

[45] Date of Patent: Oct. 13, 1987

[54] CARRIAGE

[75] Inventor: Chol Ku, Cincinnati, Ohio

[73] Assignee: Cosco, Inc., Columbus, Ind.

[21] Appl. No.: 855,337

[22] Filed: Apr. 24, 1986

[51] Int. Cl.[4] ..... B62D 7/10

[52] U.S. Cl. ..... 280/87.02 W; 180/282; 188/5; 297/5

[58] Field of Search ..... 180/282, 283; 297/5; 188/5, 20; 280/33.99 C, 87.02 W

[56] References Cited

U.S. PATENT DOCUMENTS

| | | | |
|---|---|---|---|
| 2,198,813 | 4/1940 | Hall | 155/22 |
| 2,538,324 | 1/1951 | Petrie | 155/24 |
| 3,003,780 | 10/1961 | Lundahl | 280/43 |
| 3,265,157 | 8/1966 | Rissler | 280/33.99 C |
| 3,608,693 | 9/1971 | Strosberg et al. | 280/33.99 C |
| 4,019,756 | 4/1977 | Ishida | 280/649 |
| 4,045,045 | 8/1977 | Boucher et al. | 289/87.02 |
| 4,145,682 | 3/1979 | Cook | 180/282 X |
| 4,171,132 | 10/1979 | Kassai | 272/79.3 |
| 4,231,582 | 11/1980 | Moss | 280/87 |
| 4,364,576 | 12/1982 | Kassai | 280/87 |

*Primary Examiner*—John J. Love
*Assistant Examiner*—Michael Mar
*Attorney, Agent, or Firm*—Barnes & Thornburg

[57] ABSTRACT

An improved carriage incorporates an automatic braking system that detects and reacts to the presence of a ledge and substantially inhibits movement of the carriage over the ledge. The carriage includes three rolling units pivotally coupled to a base in spaced relation about the periphery of the base. Each rolling unit includes a pair of wheels. A high friction pad is mounted on the base and presented toward the underlying surface for frictional engagement therewith. Movement of any one of the wheels over a boundary edge of the underlying surface causes the rolling unit supporting such wheel to pivot from a normally horizontal rolling position to a pivoted position. Such pivoting movement acts to collapse the carriage thereby lowering the high friction pad into frictional engagement with the underlying surface. A warning system is desirably provided for indicating engagement of the high friction pad and the underlying surface following collapse of the carriage to alert nearby persons of such collapse.

23 Claims, 6 Drawing Figures

FIG. 1
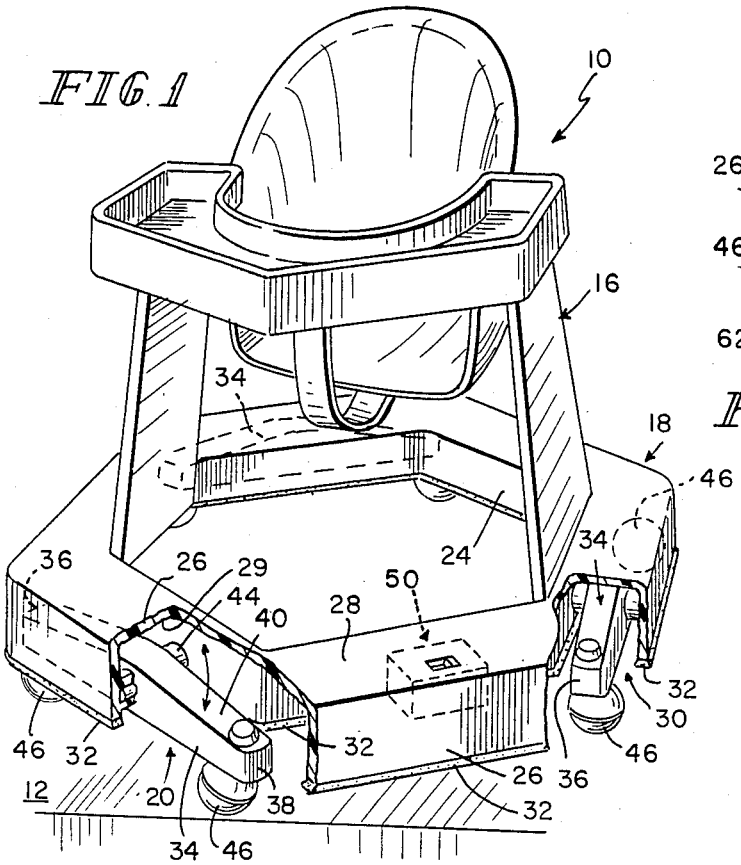
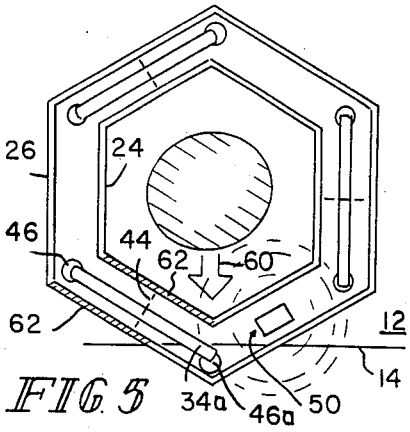
FIG. 5
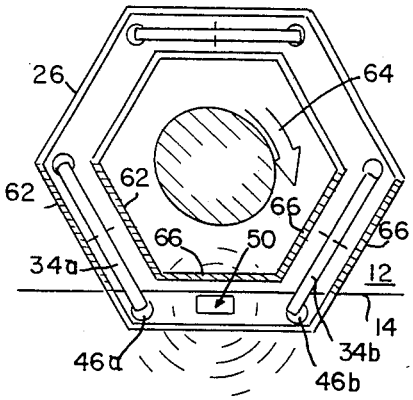
FIG. 6
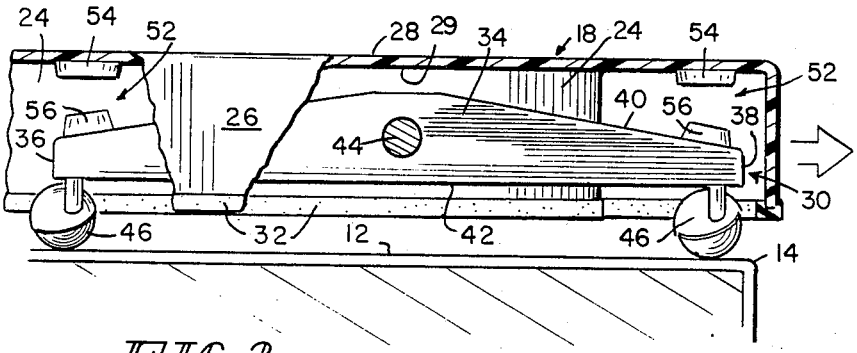
FIG. 2
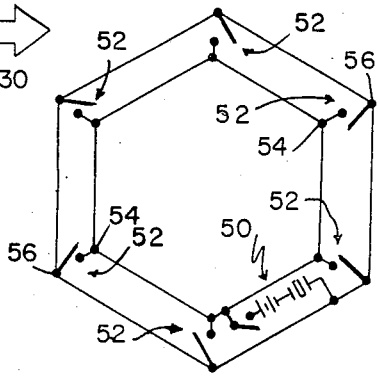
FIG. 4
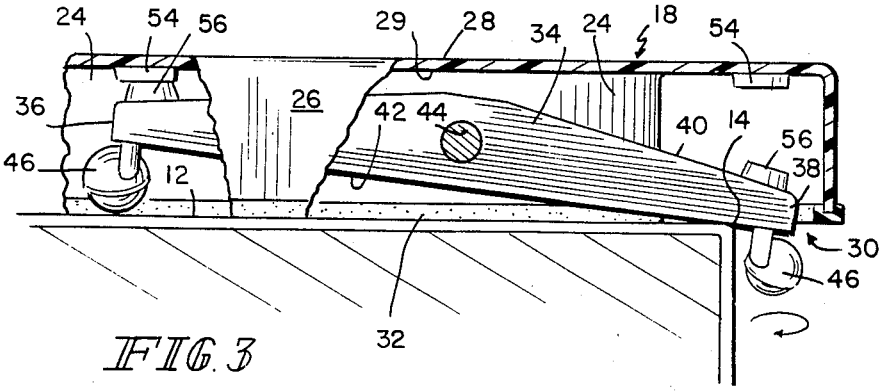
FIG. 3

CARRIAGE

BACKGROUND AND SUMMARY OF THE INVENTION

This invention relates to a brake system for a rolling carriage. More particularly, this invention relates to a baby walker equipped with a safety brake system for reacting to the presence of a ledge and inhibiting rolling movement of the baby walker on an underlying surface with respect to the ledge to help prevent the baby walker from rolling over the ledge.

Young children left unattended in conventional baby walkers are frequently injured in stairway and tip-over accidents. Oftentimes, a curious youngster will propel the baby walker right up to the top edge of a staircase, porch, patio, sidewall, or the like. Further movement of the baby carriage past the edge at the urging of the youngster can tip the entire baby walker over the edge causing the seated youngster to fall down the stairway or the like with the baby walker and suffer unwanted injury.

A rolling carriage or baby walker equipped with a safety brake system for automatically inhibiting movement of such rolling carriages and walker significantly past a drop-off boundary edge of the underlying floor without requiring supervision or intervention by another person would aid in preventing dangerous tip-over situations and otherwise avoid shortcomings of known rolling carriages and walkers.

In accordance with the present invention, an improved carriage includes a load-receiving surface supported on a base, rolling means for rollably supporting the base on an underlying surface, and means for movably coupling the rolling means to the base. The rolling means and coupling means cooperate to lower an effective portion of the base to a collapsed position in frictional engagement with the underlying surface whenever a portion of the rolling means moves over a boundary edge of the underlying surface to at least a predetermined distance below the plane of the underlying surface. In this collapsed position, movement of the base with respect to the boundary edge is inhibited to aid in preventing tip-over movement of the carriage completely over the boundary edge.

In preferred embodiments of the present invention, the carriage includes at least three rolling units pivotally coupled to a base in spaced relation about the circumference or periphery of the base. For example, the base could be of hexagonal shape. A pair of wheels is mounted in spaced-apart relation on each rolling unit to straddle the pivot axis of the rolling unit and to roll freely on the underlying surface. A high friction pad is mounted on the base and presented toward the underlying surface for frictional engagement therewith.

In operation, movement of any one of the wheels over a boundary edge of the underlying surface to a point at least a predetermined distance below the plane of the underlying surface causes the rolling unit supporting such wheel to pivot from a normally horizontal rolling position to a pivoted position. Such pivoting movement acts to lower the high friction pad or other elongated section of the base into frictional engagement with the underlying surface and lower the carriage. In addition, alarm means is desirably provided for indicating engagement of the high friction pad and the underlying surface following collapse of the carriage to alert nearby persons of such collapse by means of an audible signal.

The automatic braking feature provided by the collapsible carriage of the present invention advantageously provides means for detecting and reacting to the presence of a ledge and substantially inhibiting movement of an unsupervised carriage over the ledge. While the best mode of the invention known to the inventor involves a brake system for baby walkers, it is expected that such a feature has broader application, e.g., blocking movement of carriages or the like operated by visually-impaired persons or other handicapped persons generally unable to detect or react to the presence of drop-off ledges or the like.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a perspective view of a preferred embodiment of the present invention with portions of the base broken away to reveal a pair of pivotally mounted collapsible rolling units;

FIG. 2 is a side elevation view of the base in FIG. 1, with portions broken away, showing a pivotal rolling unit in its normal rolling position adjacent a boundary edge of an underlying surface;

FIG. 3 is a side elevation view of the base in FIG. 1 following collapse, with portions broken away, showing the pivotal rolling unit in its pivoted position and the base in frictional engagement with the underlying surface;

FIG. 4 is a schematic of an alarm circuit for indicating collapse of the embodiment of FIG. 1;

FIG. 5 is a diagrammatic view showing the base in a first position with respect to the adjacent boundary edge; and FIG. 6 is a view similar to FIG. 5 showing the base in a second position with respect to the adjacent boundary edge.

DETAILED DESCRIPTION OF THE DRAWINGS

The novel construction of the present invention provides an automatic system for braking a carriage 10 rolling on an underlying surface or ledge 12 before a large portion of the carriage 10 rolls over a boundary ledge 14 of the underlying surface 12 causing the carriage 10 to tip over spilling the occupant or other contents of the carriage 10. As shown in FIG. 1, a carriage 10 in accordance with the present invention takes the form of a baby walker in preferred embodiments.

The carriage 10 includes a seat or other load-receiving assembly 16 of any suitable construction and a hollow base 18 for supporting the seat assembly 16. The hollow base 18 is a ring member formed of six integral hollow base sections. Three pivoting wheel assemblies 20 are pivotally mounted within the hollow base 18 to permit rolling movement of the base 18 on the underlying surface 12. As is known, the seat assembly of a baby walker can include a seat, legs, and a tray and is supported above the ground 12 so that the feet of a seated child are in contact with the ground, thus permitting the child to propel the baby walker.

Referring to FIGS. 1-3, the hollow base 18 includes an inner wall 24, an outer wall 26, and a top wall 28 interconnecting the spaced-apart inner and outer walls 24, 26 to form a wheel assembly-receiving chamber 30 therebetween. The top wall 28 includes an interior surface 29. Each of the inner and outer walls 24, 26 include bottom surfaces presented toward the underlying surface 12. The base 18 further includes a high friction pad 32 mounted on these bottom surfaces to engage the underlying surface in a manner to be explained below.

In the illustrated embodiment, the hollow base 18 is hexagonally shaped to provide a stable seat-supporting platform shell for receiving at least three pivoting wheel assemblies in circumferentially spaced-apart relation. It will be appreciated that other geometric shapes including, but not limited to, circles, squares, rectangles, and triangles, can provide suitable base configurations for use in the present invention. The width of base 18 is selected to allow carriage 10 to pass through a standard 28-inch doorway.

Each wheel assembly 20 includes a pivoting support leg 34 having opposite distal ends 36, 38 and top and bottom surfaces 40, 42. Each support leg 34 is journaled for pivotal movement within the chamber 30 of one of the six hollow base sections on a pivot pin 44 interconnecting the inner and outer walls 24, 26 of such base section. A wheel or caster 46 is fixed to each of the opposite distal ends 36 and 38 of each support leg 34 to straddle the pivot pin 44 and to roll on the underlying surface 12.

In operation, pivoting wheel assemblies 20 collapse to lower an effective portion of the base 18 into frictional engagement with the underlying surface 12 whenever one of the wheels 46 is moved a sufficient distance beyond a boundary edge 14 of the ledge 12 to clear such boundary edge 14 by a child seated in carriage 10 as shown best in FIGS. 2 and 3. In its normal rolling position shown in FIG. 2, the base 18, supported by wheel assemblies 20, is in rolling engagement with the underlying surface, and each pivoting support leg 34 is maintained in substantially horizontal spaced-apart parallel relation to the underlying surface 12. Following movement of one of the wheels 46 over a boundary edge 14 of the underlying surface 12 to a point at least a predetermined distance below the plane of the underlying surface 12, the pivoting support leg 34 of such wheel 46 pivots to its pivoted position shown in FIG. 3. The base 18 is lowered in response to sufficient pivoting movement of the support leg 34 to place a sufficient portion of high friction pad 32 into engagement with the underlying surface 12 to inhibit further movement of the carriage 10 with respect to the boundary edge 14.

The carriage 10 may also include a warning system to alert supervising adults or others that a portion of the carriage 10 has passed over a boundary edge 14 of the underlying surface 12. The warning system includes an alarm unit 50 having a power source and a pair of alarm switches 52 mounted on each pivoting support leg 34. Each alarm switch 52 includes an upper contact 54 mounted on the interior surface 29 of the top wall 28 and a lower contact 56 mounted on the top surface 40 of the support leg 34 in opposing relation to the upper contact 54. The schematic illustrated in FIG. 4 shows a preferred embodiment of a continuity circuit electrically coupling the alarm unit 50 and the six alarm switches 52. As shown best in FIG. 3, the warning system is activated when the upper contact adjacent to the trailing end of support leg 34 is lowered to contact the lower contact 56 mounted on the trailing end. In a preferred embodiment, the alarm unit 50 actuates an audible signal to indicate that the carriage 10 has passed a distance beyond a boundary edge 14 of a ledge 12 at the top of a staircase or the like in excess of a threshold safety amount.

One illustrative braking sequence is depicted in FIGS. 5 and 6 to demonstrate how the brake system of the present invention inhibits movement of the carriage 10 with respect to a boundary edge 14. Once a leading wheel 46*a* of the carriage 10 moving in the direction indicated by arrow 60 passes over the boundary edge 14 in the manner described above, its support leg 34*a* is pivoted in a vertical plane about its pivot pin 44 to lower a first portion of high friction pad 32 into engagement with the underlying surface 12 and also to actuate alarm unit 50. A first engagement region 62 defined by the lowered first portion is represented by cross-hatching in one diagonal direction in FIG. 5. This friction generated by engagement of the first portion of the high friction pad 32 in the first engagement region 62 will inhibit movement of the carriage 10 in relation to the boundary edge 14 and cause the carriage 10 to rotate slightly about the engagement region 62 in the direction of arrow 64 should the child seated in carriage 10 continue to try and move the carriage 10 past the boundary edge 14 in the direction of arrow 60. Continued rotation of carriage 10 in the direction of arrow 64 will cause a second wheel 46*b* on an opposite support leg 34*b* to pass over the boundary edge 14 and lower a second portion of the high friction pad 32 into engagement with the underlying surface 12 to inhibit further movement of the carriage 10 in relation to the boundary edge 14. A second engagement region 66 defined by the lowered second portion is represented by cross-hatching in another diagonal direction in FIG. 6.

Although the invention has been described in detail with reference to certain preferred embodiments, variations and modifications exist within the scope and spirit of the invention as described and defined in the following claims.

What is claimed is:

1. A carriage comprising
a seat for carrying a load,
a base for supporting the seat,
a plurality of rolling means for rollably supporting the base on an underlying surface, and
means for pivotally coupling at least one of the rolling means to the base for pivotable movement relative to the base about a horizontal pivot axis to lower an elongated section of the base from a normal rolling position above the surface to a braking position in frictional engagement with the underlying surface in response to movement of a portion of the at least one of the rolling means over an edge of the underlying surface to a point at least a predetermined distance below the plane of the underlying surface to inhibit further movement of the base with respect to the edge, the base including a high friction pad positioned on said elongated section for frictional engagement with the underlying surface when the base is in the braking position.

2. The carriage of claim 1 further comprising alarm means for indicating engagement of an elongated section of the base and the underlying surface.

3. The carriage of claim 1, wherein the rolling means includes at least three rolling units arranged in spaced relation about the base, and the coupling means pivotally couples each rolling unit to the base for movement about the horizontal pivot axis.

4. The carriage of claim 4 wherein the ring member is hexagonally shaped.

5. The carriage of claim 3, wherein each rolling unit includes a pair of wheels positioned in spaced-apart relation to straddle the horizontal pivot axis and roll on the underlying surface, and said portion of the rolling means is at least one of the wheels so that movement of one of the wheels past an edge of the underlying surface acts to pivot its rolling unit in relation to the base from a horizontal rolling position to a pivoted position thereby lowering an elongated section of the base adjacent to the rolling unit to its braking position.

6. The carriage of claim 3 further comprising alarm means for indicating pivoting of each rolling unit to its pivoted position.

7. A carriage for rolling movement on an underlying surface, the carriage comprising a seat for carrying a child or other occupant, a base for supporting the seat, and rolling means for collapsibly elevating the base above the underlying surface normally to prevent frictional engagement of the base and the underlying surface during rolling movement of the carriage, the rolling means being configured to collapse in response to movement of a portion of the rolling means over a boundary edge of the underlying surface to lower an adjacent portion of the base into frictional engagement with the underlying surface so that continued rolling movement of the carriage on the underlying surface is inhibited, wherein the rolling means includes a plurality of support legs, each support leg being pivotally connected to the base for movement about a horizontal pivot axis, and a pair of carriage wheels fixed to each support leg in straddling relation to the horizontal pivot axis of the support leg, each support leg pivoting about its pivot axis in response to movement of one of its carriage wheels over the boundary edge of the underlying surface to collapse the rolling means, the portions of the base adjacent to the rolling means including a high friction pad for frictionally engaging the underlying surface in response to collapse of the rolling means.

8. The carriage of claim 7 wherein the plurality of support legs are arranged on the base in circumferentially spaced-apart relation.

9. The carriage of claim 7 wherein each support leg includes opposite distal ends, one wheel being fixed to each of the opposite distal ends in substantially equally spaced-apart relation to the pivot axis of the support leg.

10. The carriage of claim 7, further comprising alarm means for indicating collapse of a portion of the rolilng means to alert nearby persons that the portion of the rolling means has passed over the boundary edge of the underlying surface.

11. The carriage of claim 10 wherein the alarm means includes sonic means for issuing an audible warning to nearby persons to indicate the collapse of the rolling means.

12. A carriage for rolling movement on an underlying surface, the carriage comprising a seat for carrying a child or other occupant, a base for supporting the seat, and rolling means for collapsibly elevating the base above the underlying surface normally to prevent frictional engagement of the base and the underlying surface during rolling movement of the carriage, the rolling means being configured to collapse in response to movement of a portion of the rolling means over a boundary edge of the underlying surface to lower an adjacent portion of the base into frictional engagement with the underlying surface so that continued rolling movement of the carriage on the underlying surface is inhibited, wherein the base is hexagonally shaped and the rolling means includes three support legs connected to the hexagonal base for movement about horizontal pivot axes and arranged to lie in substantially triangular relation, each support leg having a pair of carriage wheels for normally engaging the underlying surface, one carriage wheel being fixed to each of its distal ends to straddle the horizontal pivot axis of the support leg, the portion of the base adjacent to the rolling means including a high friction pad for frictionally engaging the underlying surface in response to collapse of the rolling means.

13. A baby walker for rolling movement on an underlying surface, the baby walker comprising a seat, frame means for elevating the seat above the underlying surface to enable a seated baby to touch the underlying surface to propel the baby walker, the frame means including a base, a plurality of wheel units, each wheel unit including a pair of wheels, and means for pivotally coupling each wheel unit to the base about a horizontal pivot axis so that each pair of wheels normally engage the underlying surface to permit rolling movement thereon, each wheel unit pivoting in relation to the base in response to movement of one of its wheels over a boundary edge of the underlying surface to at least a predetermined distance below the plane of the underlying surface to lower a portion of the base into frictional engagement with the underlying surface thereby inhibiting further rolling movement of the baby walker on the underlying surface.

14. The baby walker of claim 13 wherein the portion of the base includes a high friction pad presented toward the underlying surface for frictional engagement therewith.

15. The baby walker of claim 13 wherein the base includes six integral base members serially connected in a hexagonal shape, and three wheel units are pivotally coupled to alternate base members to arrange the wheel units in substantially triangular relation about the circumference of the hexagonal base.

16. The baby walker of claim 13 wherein each wheel unit is pivotal about a central horizontal pivot axis and its wheels are mounted at opposite ends of the wheel unit in spaced-apart relation to the central horizontal pivot axis.

17. The baby walker of claim 13 further comprising alarm means for indicating movement of one of the wheels at least the predetermined distance below the plane of the underlying surface to alert a supervising adult of the existence of an emergency condition.

18. The baby walker of claim 17 wherein the alarm means includes sonic means for issuing an audible warning to the supervising adult.

19. The baby walker of claim 13 wherein the base is a continuous ring member having an inner wall and an outer wall positioned in spaced-apart relation to the inner wall to define a chamber therebetween, and each coupling means includes a pivot pin journaled to the inner and outer walls on which the wheel unit is mounted for pivotal movement in a substantially vertical plane within the chamber.

20. The baby walker of claim 13 further comprising alarm means for indicating engagement of said portion of the base and the underlying surface, the alarm means including sonic means for issuing an audible warning and switch means for actuating the sonic means in response to movement of one of the wheels at least a predetermined distance below the plane of the underlying surface.

21. The baby walker of claim 20 wherein the base includes a top wall interconnecting the inner and outer walls, and the switch means includes an upper contact mounted on the top wall to lie within the chamber and an opposing lower contact mounted on one end of the wheel unit in facing relation to the fixed contact, the lower contact being movable along a path between an inactive position during normal rolling movement of the baby walker and an alarm-actuating position engaging the upper contact in response to pivoting movement of the one end of the wheel unit about the horizontal pivot axis to actuate the sonic means.

22. The baby walker of claim 21 wherein a pair of switch means are provided for each wheel unit, one switch means being positioned at one end of said each wheel unit and the other switch means being positioned at the other end of said each wheel unit.

23. A carriage comprising a platform for receiving a load, a base for supporting the platform, the base being formed to include a downwardly opening chamber, high friction means along a bottom edge of the base a plurality of rolling means received in the chamber for supporting the base for movement in a raised position above and across an underlying surface, and means interconnecting each rolling means and the base for retracting a portion of the rolling means extending outside the chamber to a position within the chamber to lower a portion of said high friction means along a section of the base from the raised position into frictional engagement with the underlying surface, said retraction means being responsive to movement of another portion of the rolling means over a ledge of the underlying surface to a point at least a predetermined distance below the plane of the underlying surface.

* * * * *

UNITED STATES PATENT AND TRADEMARK OFFICE

CERTIFICATE OF CORRECTION

PATENT NO. : 4,699,392

DATED : October 13, 1987

INVENTOR(S) : Chol Ku

It is certified that error appears in the above-identified patent and that said Letters Patent is hereby corrected as shown below:

At column 5, line 3, please delete "claim 4" and insert therefor --claim 3--; and At column 5, line 55, please delete "rolilng" and insert therefor --rolling--.

Signed and Sealed this

Third Day of May, 1988

*Attest:*

*Attesting Officer*

DONALD J. QUIGG

*Commissioner of Patents and Trademarks*